US009318076B2

(12) United States Patent
Kwak et al.

(10) Patent No.: US 9,318,076 B2
(45) Date of Patent: Apr. 19, 2016

(54) PIXEL LUMINANCE COMPENSATING UNIT, FLAT PANEL DISPLAY DEVICE HAVING THE SAME AND METHOD OF ADJUSTING A LUMINANCE CURVE FOR RESPECTIVE PIXELS

(71) Applicant: Samsung Display Co., Ltd., Yongin (KR)

(72) Inventors: Boo-Dong Kwak, Yongin (KR); In-Bok Song, Yongin (KR); Choong-Sun Shin, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 89 days.

(21) Appl. No.: 13/952,497

(22) Filed: Jul. 26, 2013

(65) Prior Publication Data

US 2014/0152718 A1 Jun. 5, 2014

(30) Foreign Application Priority Data

Nov. 30, 2012 (KR) ..... 10-2012-0137608

(51) Int. Cl.
*G09G 5/10* (2006.01)

(52) U.S. Cl.
CPC ..... *G09G 5/10* (2013.01); *G09G 2320/04* (2013.01); *G09G 2320/066* (2013.01); *G09G 2320/0693* (2013.01)

(58) Field of Classification Search
CPC ..... G09G 2320/0233; G09G 2320/0693; G09G 5/10; G09G 5/02; G09G 3/2003; G09G 3/3607; G09G 2320/04; G09G 2320/041; G09G 2320/043; G09G 2320/045; G09G 2320/046; G09G 2320/0626; G09G 2320/066; G09G 2320/0673; G09G 2320/0646; G09G 1/28; H04N 5/2352; H04N 5/243
See application file for complete search history.

(56) References Cited

U.S. PATENT DOCUMENTS 7,317,462 B2 * 1/2008 Lu ..... G09G 3/3611 345/690
7,495,679 B2 * 2/2009 Chou ..... 345/690
(Continued)

FOREIGN PATENT DOCUMENTS

KR 10-2008-0002579 (A) 1/2008
KR 10-2008-0051817 (A) 6/2008
KR 10-2009-0062764 (A) 6/2009

*Primary Examiner* — Dwayne Bost
*Assistant Examiner* — Darlene M Ritchie
(74) *Attorney, Agent, or Firm* — Knobbe, Martens, Olson & Bear LLP

(57) ABSTRACT

A pixel luminance compensating unit is disclosed. In one aspect, the disclosed pixel luminance compensating unit includes an uncompensated gray-level region processing unit configured to generate first output-data by processing first input-data corresponding to a first portion of an input luminance curve corresponding to an uncompensated gray-level region. The disclosed unit further includes a compensated gray-level region processing unit configured to generate second output-data by processing second input-data corresponding to a second portion of the input luminance curve corresponding to a compensated gray-level region. The disclosed unit further includes an interpolated gray-level region processing unit configured to generate third output-data by processing third input-data corresponding to a third portion of the input luminance curve corresponding to an interpolated gray-level region, wherein the interpolated gray-level region processing unit is configured to generate the third portion by interpolating between the first portion and the second portion.

19 Claims, 8 Drawing Sheets

(56) References Cited

U.S. PATENT DOCUMENTS 8,013,877 B2 * 9/2011 Ou-Yang et al. ..... 345/690
8,619,102 B2 * 12/2013 Chen ..... G09G 3/2044 345/102
2001/0033260 A1 * 10/2001 Nishitani ..... G09G 3/3406 345/87
2005/0024310 A1 * 2/2005 Shiomi ..... G09G 3/3648 345/89
2005/0206636 A1 * 9/2005 Kanai ..... 345/204
2005/0265599 A1 * 12/2005 Huang et al. ..... 382/169
2006/0044242 A1 * 3/2006 Park et al. ..... 345/89
2007/0013622 A1 * 1/2007 Stoops ..... 345/84
2008/0030450 A1 * 2/2008 Yamagishi et al. ..... 345/89
2008/0143753 A1 * 6/2008 Ou-Yang et al. ..... 345/690
2008/0240605 A1 * 10/2008 Enjuji ..... G06T 5/009 382/274
2008/0252666 A1 * 10/2008 Chen et al. ..... 345/690
2009/0097747 A1 * 4/2009 Chen et al. ..... 382/169
2009/0123068 A1 * 5/2009 Huang et al. ..... 382/169
2009/0153592 A1 6/2009 Choi et al.
2010/0238356 A1 * 9/2010 Kida ..... G09G 3/20 348/618
2011/0115829 A1 * 5/2011 Ito ..... G09G 3/3426 345/690
2011/0148942 A1 * 6/2011 Furihata et al. ..... 345/690
2011/0254878 A1 * 10/2011 Mori ..... G09G 3/2007 345/690
2012/0187999 A1 * 7/2012 Lin ..... 327/355
2012/0242710 A1 * 9/2012 Kang ..... G09G 3/3208 345/690
2012/0262503 A1 * 10/2012 Lin et al. ..... 345/690
2012/0268436 A1 * 10/2012 Chang ..... 345/207

* cited by examiner

PIXEL LUMINANCE COMPENSATING UNIT, FLAT PANEL DISPLAY DEVICE HAVING THE SAME AND METHOD OF ADJUSTING A LUMINANCE CURVE FOR RESPECTIVE PIXELS

CROSS-REFERENCE TO RELATED APPLICATIONS

This application claims priority under 35 USC §119 to Korean Patent Applications No. 10-2012-0137608, filed on Nov. 30, 2012 in the Korean Intellectual Property Office (KIPO), the contents of which are incorporated herein in its entirety by reference.

BACKGROUND

1. Field

The disclosed technology relates generally to a display device. More particularly, the disclosed technology relates to a pixel luminance compensating unit that compensates a pixel luminance of respective pixels included in a display panel, a flat panel display device having the pixel luminance compensating unit, and a method of adjusting a luminance curve for respective pixels.

2. Description of the Related Technology

Recently, liquid crystal display (LCD) and organic light emitting display (OLED) technologies have been widely used in flat panel displays. Generally, the flat panel display device includes a display panel having a plurality of pixels, a scan driving unit that provides a scan signal to the display panel, a data driving unit that provides a data signal to the display panel, and a timing control unit that controls the driving units. Conventional flat panel displays employ an optical compensating technique by which pixel luminance is compensated. That is, a specific test pattern is displayed on the display panel and the displayed pattern is photographed by a camera device, and an electronic adjustment is applied to the pixels. The ability to compensate pixel luminance has limits because compensation is applied across an entire gray-level region. As described herein, a gray level region refers to a continuous portion of a luminance curve in a luminance versus gray-level graph.

SUMMARY OF CERTAIN INVENTIVE ASPECTS

Some example embodiments provide a pixel luminance compensating unit capable of achieving pixel luminance continuity of respective pixels of a display panel in an entire gray-level region when compensating a pixel luminance of respective pixels of the display panel in a compensation gray-level region.

Some example embodiments provide a flat panel display device having the pixel luminance compensating unit capable of achieving high luminance uniformity in an entire gray-level region when outputting (i.e., displaying) an image.

Some example embodiments provide a method of adjusting a luminance curve for respective pixels capable of preventing discontinuity between a luminance curve of a compensation gray-level region and a luminance curve of an uncompensated gray-level region when compensating a pixel luminance of respective pixels of a display panel in the compensation gray-level region.

According to some example embodiments, a pixel luminance compensating unit may include an uncompensated gray-level region processing unit configured to generate first output-data by processing first input-data corresponding to the uncompensated gray-level region based on a luminance curve of the uncompensated gray-level region for respective pixels, a compensated gray-level region processing unit configured to generate second output-data by processing second input-data corresponding to a compensated gray-level region based on a luminance curve of the compensated gray-level region for the respective pixels, and an interpolated gray-level region processing unit configured to generate third output-data by processing third input-data corresponding to an interpolated gray-level region based on a luminance curve of the interpolated gray-level region for the respective pixels. Here, the luminance curve of the interpolated gray-level region may be generated by performing an interpolation between the luminance curve of the uncompensated gray-level region and the luminance curve of the compensated gray-level region.

In example embodiments, the interpolated gray-level region may be placed between the compensated gray-level region and the uncompensated gray-level region.

In example embodiments, the luminance curve of the uncompensated gray-level region, the luminance curve of the compensated gray-level region, and the luminance curve of the interpolated gray-level region may be connected.

In example embodiments, the first output-data may correspond to non-compensated-data generated by not performing pixel luminance compensation on the first input-data.

In example embodiments, the second output-data may correspond to compensated-data generated by performing pixel luminance compensation on the second input-data.

In example embodiments, the third output-data may correspond to compensated-data generated by performing pixel luminance compensation on the third input-data.

In example embodiments, the uncompensated gray-level region may correspond to a relatively high luminance gray-level region, and the compensated and interpolated gray-level regions may correspond to a relatively low luminance gray-level region.

In example embodiments, the uncompensated gray-level region may correspond to a relatively low luminance gray-level region, and the compensated and interpolated gray-level regions may correspond to a relatively high luminance gray-level region.

According to some example embodiments, a flat panel display device may include a display panel, a scan driving unit configured to provide a scan signal to the display panel, a data driving unit configured to provide a data signal to the display panel, a pixel luminance compensating unit configured to compensate a pixel luminance of respective pixels of the display panel in a partial gray-level region, and a timing control unit configured to control the scan driving unit, the data driving unit, and the pixel luminance compensating unit.

In example embodiments, the pixel luminance compensating unit may be integrated in the timing control unit or the data driving unit.

In example embodiments, the flat panel display device may correspond to an organic light emitting display device including a power unit that provides a high voltage and a low voltage to the display panel.

In example embodiments, the flat panel display device may correspond to a liquid crystal display device including a backlight unit that provides a light to the display panel.

In example embodiments, the pixel luminance compensating unit may include an uncompensated gray-level region processing unit configured to generate first output-data by processing first input-data corresponding to the uncompensated gray-level region based on a luminance curve of the uncompensated gray-level region for the respective pixels, a compensated gray-level region processing unit configured to generate second output-data by processing second input-data corresponding to a compensated gray-level region based on a luminance curve of the compensated gray-level region for the respective pixels, and an interpolated gray-level region processing unit configured to generate third output-data by processing third input-data corresponding to an interpolated gray-level region based on a luminance curve of the interpolated gray-level region for the respective pixels. Here, the luminance curve of the interpolated gray-level region may be generated by performing an interpolation between the luminance curve of the uncompensated gray-level region and the luminance curve of the compensated gray-level region.

In example embodiments, the interpolated gray-level region may be placed between the compensated gray-level region and the uncompensated gray-level region.

In example embodiments, the luminance curve of the uncompensated gray-level region, the luminance curve of the compensated gray-level region, and the luminance curve of the interpolated gray-level region may be connected.

In example embodiments, the first output-data may correspond to non-compensated-data generated by not performing pixel luminance compensation on the first input-data.

In example embodiments, the second output-data may correspond to compensated-data generated by performing pixel luminance compensation on the second input-data.

In example embodiments, the third output-data may correspond to compensated-data generated by performing pixel luminance compensation on the third input-data.

According to some example embodiments, a method of adjusting a luminance curve for respective pixels included in a display panel may include a step of detecting a measured luminance curve of an entire gray-level region for the respective pixels, a step of checking a luminance curve of an uncompensated gray-level region for the respective pixels, a step of adjusting a luminance curve of a compensated gray-level region for the respective pixels, and a step of generating a luminance curve of an interpolated gray-level region for the respective pixels by performing an interpolation between the luminance curve of the uncompensated gray-level region and the luminance curve of the compensated gray-level region.

In example embodiments, the interpolated gray-level region may be placed between the compensated gray-level region and the uncompensated gray-level region.

In example embodiments, the luminance curve of the uncompensated gray-level region, the luminance curve of the compensated gray-level region, and the luminance curve of the interpolated gray-level region may be connected.

Therefore, a pixel luminance compensating unit according to example embodiments may achieve pixel luminance continuity of respective pixels of a display panel in an entire gray-level region by generating a luminance curve of an interpolated gray-level region based on an interpolation between a luminance curve of a compensated gray-level region and a luminance curve of the uncompensated gray-level region when compensating a pixel luminance of respective pixels of the display panel in a compensation gray-level region (i.e., the compensated gray-level region and the interpolated gray-level region).

In addition, a flat panel display device having the pixel luminance compensating unit according to example embodiments may achieve high luminance uniformity in an entire gray-level region when outputting an image.

Further, a method of adjusting a luminance curve for respective pixels according to example embodiments may generate a luminance curve of an interpolated gray-level region based on an interpolation between a luminance curve of a compensated gray-level region and a luminance curve of the uncompensated gray-level region when compensating a pixel luminance of respective pixels of the display panel in a compensation gray-level region (i.e., the compensated gray-level region and the interpolated gray-level region). As a result, continuity between the luminance curve of the compensation gray-level region and the luminance curve of the uncompensated gray-level region may be achieved.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Figure 1:
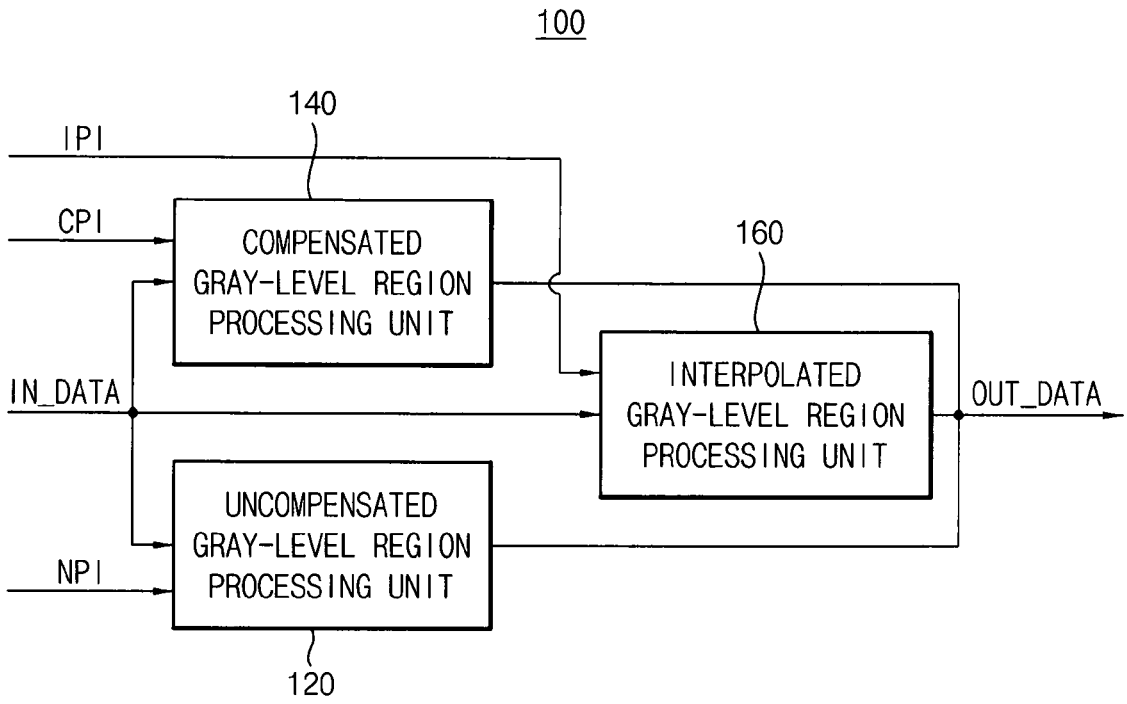
FIG. 1 is a block diagram illustrating a pixel luminance compensating unit according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2A:
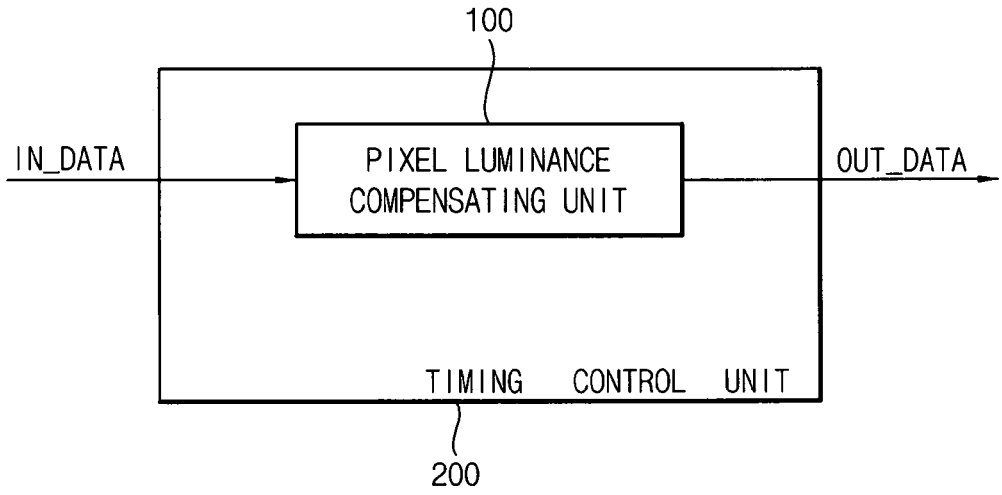
FIG. 2A is a block diagram illustrating an example in which a pixel luminance compensating unit of FIG. 1 is located inside a timing control unit of a flat panel display device.
Figure 2B:
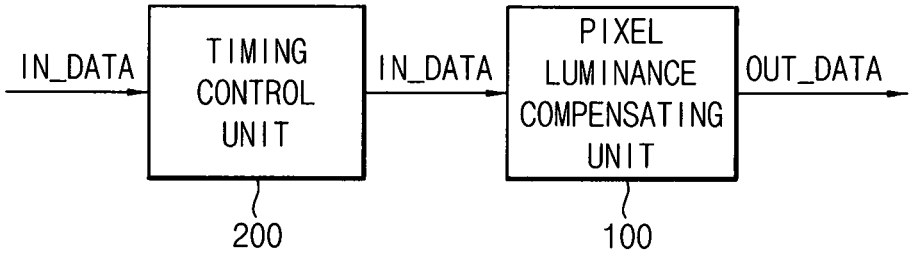
FIG. 2B is a block diagram illustrating an example in which a pixel luminance compensating unit of FIG. 1 is located outside a timing control unit of a flat panel display device.

FIG. 1 is a block diagram illustrating a pixel luminance compensating unit according to example embodiments. FIG. 2A is a block diagram illustrating an example in which a pixel luminance compensating unit of FIG. 1 is located inside a timing control unit of a flat panel display device. FIG. 2B is a block diagram illustrating an example in which a pixel luminance compensating unit of FIG. 1 is located outside a timing control unit of a flat panel display device.

Referring to FIGS. 1, 2A, and 2B, the pixel luminance compensating unit 100 can include an uncompensated gray-level region processing unit 120, a compensated gray-level region processing unit 140, and an interpolated gray-level region processing unit 160. Here, the pixel luminance compensating unit 100 may be included in a flat panel display device (e.g., a liquid crystal display device, an organic light emitting display device, etc.). As used herein, interpolation refers to construction of data points within a gray level region based on data points outside the gray level region based on a predetermined gray level interpolation algorithm.

The uncompensated gray-level region processing unit 120 can generate first output-data OUT_DATA by processing first input-data IN_DATA corresponding to (i.e., placed in) the uncompensated gray-level region based on a luminance curve NPI of the uncompensated gray-level region for respective pixels included in a display panel. The pixel luminance compensating unit 100 can compensate a pixel luminance using an optical compensating technique (i.e., a specific pattern is displayed on the display panel, and then the display panel is photographed by a camera device). However, the luminance curve NPI of the uncompensated gray-level region may not be compensated based on a measured luminance curve because the pixel luminance compensating unit 100 compensates the pixel luminance of respective pixels of the display panel only in a compensation gray-level region. Thus, the first output-data OUT_DATA may correspond to non-compensated-data generated by not performing pixel luminance compensation on the first input-data IN_DATA. In one example embodiment, the uncompensated gray-level region corresponds to a relatively high luminance gray-level region, as may be the case in situations where gray-level regions having relatively low gray levels suffer from having poor luminance uniformity of the pixels. In another example embodiment, the uncompensated gray-level region corresponds to a relatively low luminance gray-level region, as may be the case in situations where gray level regions having relatively high gray-levels suffer from having poor luminance uniformity of the pixels. In conclusion, the uncompensated gray-level region processing unit 120 may not compensate the first input-data IN_DATA corresponding to the uncompensated gray-level region for respective pixels included in the display panel. Thus, the uncompensated gray-level region processing unit 120 may output the first output-data OUT_DATA (i.e., the non-compensated-data generated by not performing the pixel luminance compensation on the first input-data IN_DATA).

The compensated gray-level region processing unit 140 may generate second output-data OUT_DATA by processing second input-data IN_DATA corresponding to (i.e., placed in) a compensated gray-level region based on a luminance curve CPI of the compensated gray-level region for respective pixels included in the display panel. As described above, the pixel luminance compensating unit 100 may compensate the pixel luminance using the optical compensating technique. Here, the luminance curve CPI of the compensated gray-level region may be compensated based on the measured luminance curve because the pixel luminance compensating unit 100 compensates the pixel luminance of respective pixels of the display panel in the compensation gray-level region (i.e., the compensated gray-level region and the interpolated gray-level region). The interpolated gray-level region is adjacent to the uncompensated gray-level region. Thus, the second output-data OUT_DATA may correspond to compensated-data generated by performing the pixel luminance compensation on the second input-data IN_DATA. The interpolated gray-level region processing unit 160 may generate third output-data OUT_DATA by processing third input-data IN_DATA corresponding to (i.e., placed in) an interpolated gray-level region based on a luminance curve IPI of the interpolated gray-level region for respective pixels included in the display panel. Here, the interpolated gray-level region is located between the compensated gray-level region and the uncompensated gray-level region. As described above, the pixel luminance compensating unit 100 may compensate the pixel luminance using the optical compensating technique. Here, the luminance curve IPI of the interpolated gray-level region may be compensated based on the measured luminance curve because the pixel luminance compensating unit 100 compensates the pixel luminance of pixels included in the compensation gray-level region (i.e., the compensated gray-level region and the interpolated gray-level region). Thus, the third output-data OUT_DATA may correspond to compensated-data generated by performing the pixel luminance compensation on the third input-data IN_DATA.

When the luminance curve IPI of the interpolated gray-level region is compensated based on the measured luminance curve for respective pixels included in the display panel, the luminance curve IPI of the interpolated gray-level region may be generated by performing an interpolation between the luminance curve NPI of the uncompensated gray-level region and the luminance curve CPI of the compensated gray-level region. That is, for respective pixels included in the display panel, the luminance curve CPI of the compensated gray-level region may be adjusted based on the measured luminance curve, the luminance curve NPI of the uncompensated gray-level region may not be adjusted based on the measured luminance curve, and the luminance curve IPI of the interpolated gray-level region may be generated based on the interpolation between the luminance curve NPI of the uncompensated gray-level region and the luminance curve CPI of the compensated gray-level region on. For example, a discontinuity between the luminance curve of the relatively low luminance gray-level region and the luminance curve of the relatively high luminance gray-level region may be caused when the luminance curve of the relatively low luminance gray-level region is adjusted (i.e., compensated) based on the measured luminance curve, but the luminance curve of the relatively high luminance gray-level region is not adjusted (i.e., not compensated) based on the measured luminance curve for respective pixels included in the display panel. Similarly, a discontinuity between the luminance curve of the relatively low luminance gray-level region and the luminance curve of the relatively high luminance gray-level region may also be caused when the luminance curve of the relatively high luminance gray-level region is adjusted (i.e., compensated) based on the measured luminance curve, but the luminance curve of the relatively low luminance gray-level region is not adjusted (i.e., not compensated) based on the measured luminance curve for respective pixels included in the display panel. Thus, the pixel luminance compensating unit 100 may connect the luminance curve NPI of the uncompensated gray-level region, the luminance curve CPI of the compensated gray-level region, and the luminance curve IPI of the interpolated gray-level region by generating the luminance curve IPI of the interpolated gray-level region based on the interpolation between the luminance curve NPI of the uncompensated gray-level region and the luminance curve CPI of the compensated gray-level region.

As described above, the pixel luminance compensating unit 100 may compensate the pixel luminance of respective pixels of the display panel only in the compensation gray-level region (i.e., the compensated gray-level region and the interpolated gray-level region). Nevertheless, the pixel luminance compensating unit 100 may prevent discontinuity between the luminance curve of the compensation gray-level region (e.g., the relatively low luminance gray-level region) and the luminance curve of the uncompensated gray-level region (e.g., the relatively high luminance gray-level region) by generating the luminance curve IPI of the interpolated gray-level region based on the interpolation between the luminance curve CPI of the compensated gray-level region and the luminance curve NPI of the uncompensated gray-level region. Thus, the pixel luminance compensating unit 100 may achieve the pixel luminance continuity of respective pixels of the display panel in an entire gray-level region. As a result, a flat panel display device (e.g., a liquid crystal display device, an organic light emitting display device, etc.) having the pixel luminance compensating unit 100 may achieve the high luminance uniformity in an entire gray-level region when outputting (i.e., displaying) an image. In one example embodiment, as illustrated in 2A, the pixel luminance compensating unit 100 may be located (i.e., implemented) inside the timing control unit 200. In another example embodiment, as illustrated in 2B, the pixel luminance compensating unit 100 may be located (i.e., implemented) outside the timing control unit 200. In still another example embodiment, the pixel luminance compensating unit 100 may be located (i.e., implemented) inside a data driving unit. Thus, the location of the luminance compensating unit 100 is flexible according to implementations.

Figure 3:
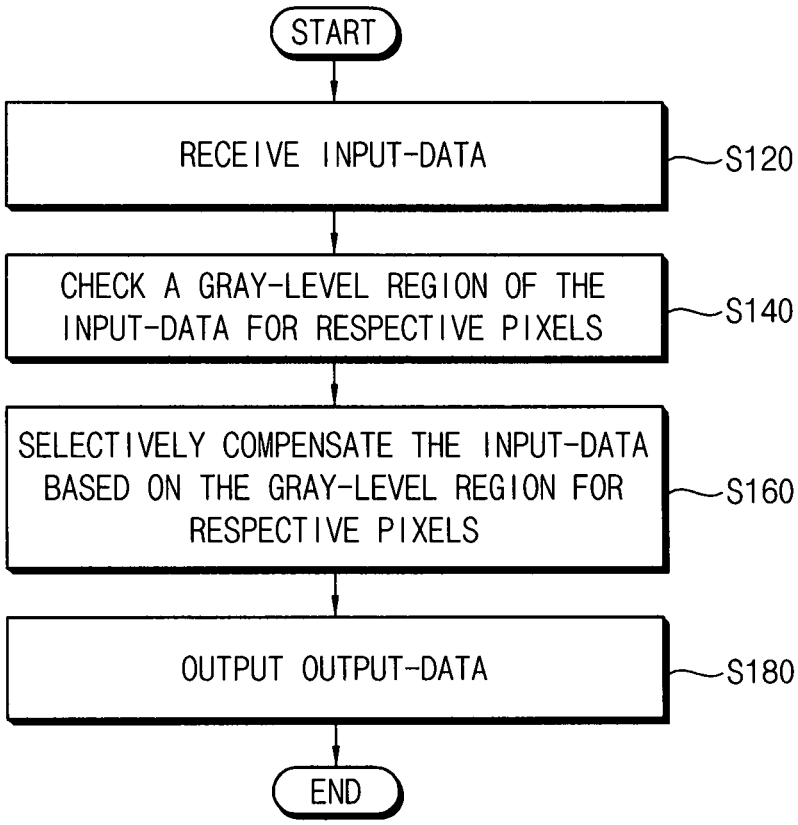
FIG. 3 is a flow-chart illustrating an operation of a pixel luminance compensating unit of FIG. 1.
Figure 4:
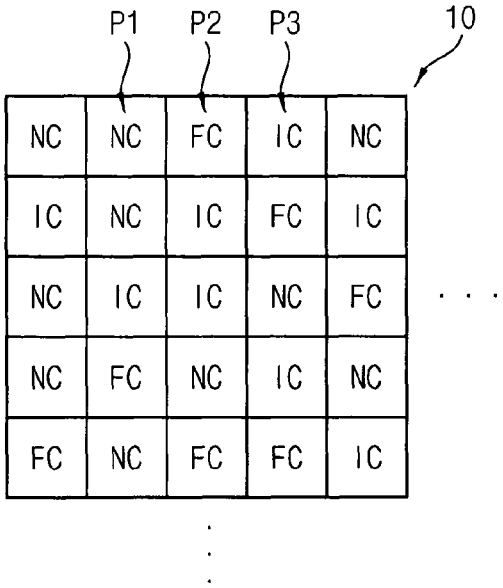
FIG. 4 is a diagram illustrating an operation of a pixel luminance compensating unit of FIG. 1.

FIG. 3 is a flow chart illustrating an operation of a pixel luminance compensating unit of FIG. 1. FIG. 4 is a diagram illustrating an operation of a pixel luminance compensating unit of FIG. 1.

Referring to FIGS. 3 and 4, the pixel luminance compensating unit 100 may receive input-data IN_DATA (Step S120), may check a gray-level region of the input-data IN_DATA for respective pixels included in the display panel 10 (Step S140), and then may selectively compensate the input-data IN_DATA based on the gray-level region of the input-data IN_DATA for respective pixels included in the display panel 10 (Step S160). Subsequently, the pixel luminance compensating unit 100 may output output-data OUT_DATA (Step S180).

Specifically, when the pixel luminance compensating unit 100 receives the input-data IN_DATA (Step S120), the pixel luminance compensating unit 100 may check the gray-level region of the input-data IN_DATA for respective pixels included in the display panel 10 (Step S140). As illustrated in FIG. 4, the input-data IN_DATA received by respective pixels of the display panel 10 may be classified into first input-data NC corresponding to the uncompensated gray-level region, second input-data FC corresponding to the compensated gray-level region, and third input-data IC corresponding to the interpolated gray-level region. Therefore, the pixel luminance compensating unit 100 may selectively compensate the input-data IN_DATA based on the gray-level region of the input-data IN_DATA for respective pixels included in the display panel 10. In other words, the pixel luminance compensating unit 100 may control first pixels P1, where the first pixels P1 receive the first input-data NC corresponding to the uncompensated gray-level region, to output first output-data generated by not performing pixel luminance compensation on the first input-data NC, may control second pixels P2, where the second pixels P2 receive the second input-data FC corresponding to the compensated gray-level region, to output second output-data generated by performing the pixel luminance compensation on the second input-data FC, and may control third pixels P3, where the third pixels P3 receive the third input-data IC corresponding to the interpolated gray-level region, to output third output-data generated by performing the pixel luminance compensation on the third input-data IC.

As described above, the pixel luminance compensating unit 100 may not compensate the first input-data NC corresponding to the uncompensated gray-level region for respective pixels included in the display panel 10. However, the pixel luminance compensating unit 100 may compensate the second input-data FC corresponding to the compensated gray-level region and the third input data IC corresponding to the interpolated gray-level region. That is, the pixel luminance compensating unit 100 may selectively perform the pixel luminance compensation for respective pixels included in the display panel 10. Here, for respective pixels included in the display panel 10, the pixel luminance compensating unit 100 may generate the luminance curve IPI of the interpolated gray-level region for compensating the third input-data IC corresponding to the interpolated gray-level region by performing an interpolation between the luminance curve CPI of the compensated gray-level region and the luminance curve NPI of the uncompensated gray-level region. As a result, the pixel luminance compensating unit 100 may achieve the pixel luminance continuity of respective pixels of the display panel 10 in an entire gray-level region because the luminance curve NPI of the uncompensated gray-level region, the luminance curve CPI of the compensated gray-level region, and the luminance curve IPI of the interpolated gray-level region are connected for respective pixels included in the display panel 10. Here, it should be understood that the input-data IN_DATA illustrated in FIG. 1 are classified into the first input-data NC, the second input-data FC, and the third input-data IC based on the gray-level region of the input-data IN_DATA. In addition, it should be also understood that the output-data OUT_DATA illustrated in FIG. 1 are classified into the first output-data, the second output-data, and the third output-data.

Figure 5:
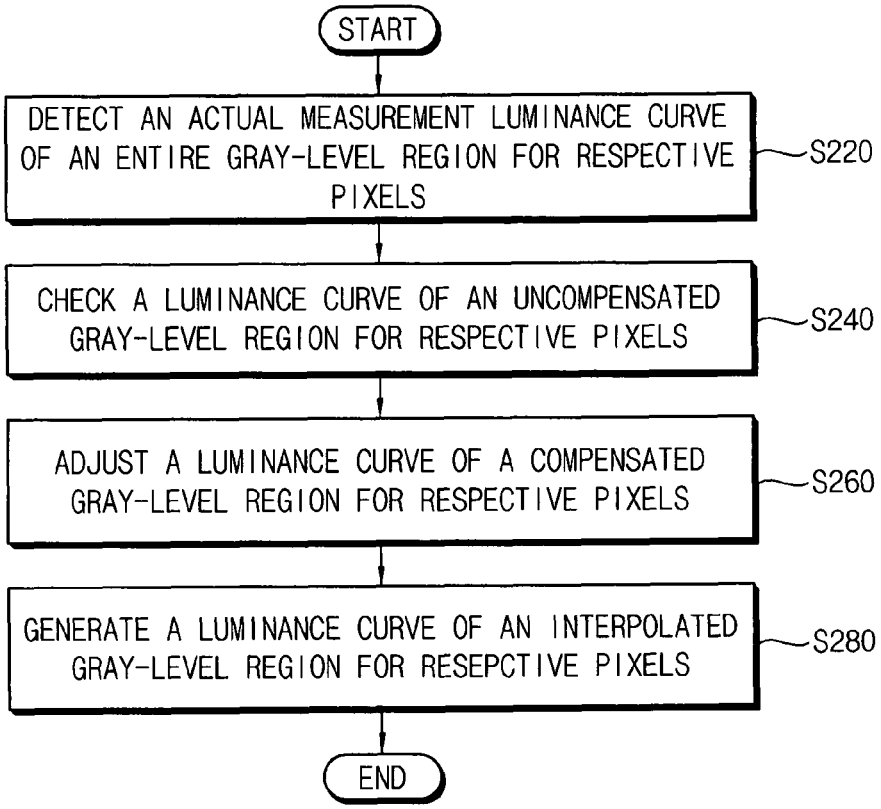
FIG. 5 is a flow-chart illustrating a method of adjusting a luminance curve for respective pixels according to example embodiments.
Figure 6:
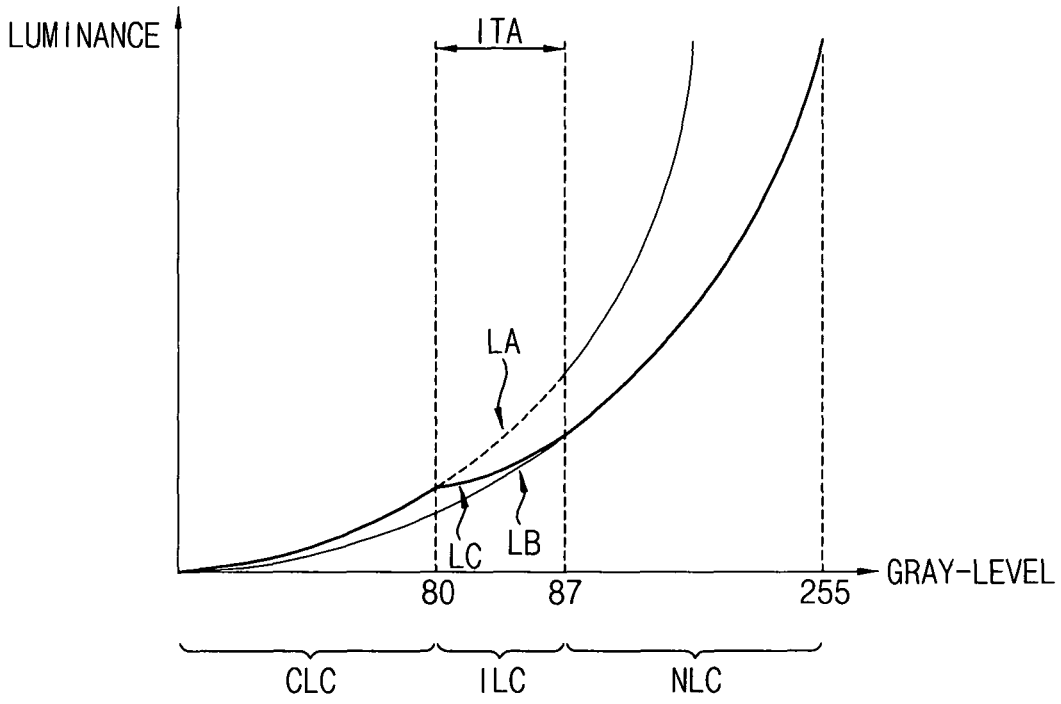
FIG. 6 is a graph illustrating a luminance curve for respective pixels that is generated by a method of FIG. 5.

FIG. 5 is a flow chart illustrating a method of adjusting a luminance curve for respective pixels according to example embodiments. FIG. 6 is a graph illustrating a luminance curve for respective pixels that is generated by a method of FIG. 5.

Referring to FIGS. 5 and 6, the method of FIG. 5 may detect a measured luminance curve LB of an entire gray-level region for respective pixels included in a display panel (Step S220), may check a luminance curve LB of an uncompensated gray-level region NLC for respective pixels included in the display panel (Step S240), may adjust a luminance curve LA of a compensated gray-level region CLC for respective pixels included in the display panel (Step S260), and then may generate a luminance curve LC of an interpolated gray-level region ILC for respective pixels included in the display panel (Step S280).

Specifically, the method of FIG. 5 may detect the measured luminance curve LB of the entire gray-level region for respective pixels included in the display panel (Step S220). For example, the method of FIG. 5 may detect the measured luminance curve LB of the entire gray-level region for respective pixels included in the display panel by displaying a specific pattern on the display panel, and then by measuring a pixel luminance of respective pixels using a camera device (e.g., an image sensor for checking emission characteristics of respective pixels) in each scan-line. However, a way for detecting the measured luminance curve LB is not limited thereto. Subsequently, the method of FIG. 5 may check the luminance curve LB of the uncompensated gray-level region NLC for respective pixels included in the display panel (Step S240). Since the method of FIG. 5 compensates a pixel luminance of respective pixels of the display panel only in the compensated and interpolated gray-level regions CLC and ILC, the luminance curve LB of the uncompensated gray-level region NLC may not be compensated based on the measured luminance curve LB. That is, the luminance curve LB of the uncompensated gray-level region NLC corresponds to the measured luminance curve LB of the uncompensated gray-level region NLC. It is illustrated in FIG. 6 that the uncompensated gray-level region NLC corresponds to a relatively high luminance gray-level region and the compensated interpolated gray-level regions CLC and ILC correspond to a relatively low luminance gray-level region. This is because a relatively low luminance gray-level region usually has difficulties to achieve high luminance uniformity of the display panel. According to some example embodiments, the uncompensated gray-level region NLC may correspond to a relatively low luminance gray-level region if a relatively high luminance gray-level region has difficulties to achieve the high luminance uniformity of the display panel.

Next, the method of FIG. 5 may adjust the luminance curve LA of the compensated gray-level region CLC for respective pixels included in the display panel (Step S260). Since the method of FIG. 5 compensates the pixel luminance of respective pixels of the display panel in the compensated and the interpolated gray-level regions CLC and ILC, the luminance curve LA of the compensated gray-level region CLC may be compensated based on the measured luminance curve LB of the entire gray-level region. Subsequently, the method of FIG. 5 may generate the luminance curve LC of the interpolated gray-level region ILC for respective pixels included in the display panel (Step S280). Since the method of FIG. 5 compensates the pixel luminance of respective pixels of the display panel in compensated and interpolated gray-level regions CLC and ILC, the luminance curve LC of the interpolated gray-level region ILC may be compensated based on the measured luminance curve LB of the entire gray-level region. In order to connect the luminance curve LB of the uncompensated gray-level region NLC, the luminance curve LA of the compensated gray-level region CLC, and the luminance curve LC of the interpolated gray-level region ILC, the method of FIG. 5 may generate the luminance curve LC of the interpolated gray-level region ILC by performing an interpolation ITA between the luminance curve LB of the uncompensated gray-level region NLC and the luminance curve LA of the compensated gray-level region CLC. As described above, for respective pixels included in the display panel, the method of FIG. 5 may adjust the luminance curve LA of the compensated gray-level region CLC based on the measured luminance curve LB of the entire gray-level region, may not adjust the luminance curve LB of the uncompensated gray-level region NLC based on the measured luminance curve LB of the entire gray-level region, and may generate the luminance curve LC of the interpolated gray-level region ILC based on an interpolation ITA between the luminance curve LA of the compensated gray-level region CLC and the luminance curve LB of the uncompensated gray-level region NLC.

As described above, the method of FIG. 5 may compensate the pixel luminance of respective pixels of the display panel only in the compensation gray-level region (i.e., the compensated gray-level region CLC and the interpolated gray-level region ILC). Nevertheless, the method of FIG. 5 may achieve continuity between the luminance curves LA and LC of the compensated and interpolated gray-level regions CLC and ILC and the luminance curve LB of the uncompensated gray-level region NLC by generating the luminance curve LC of the interpolated gray-level region ILC based on the interpolation ITA between the luminance curve LA of the compensated gray-level region CLC and the luminance curve LB of the uncompensated gray-level region NLC. Thus, the method of FIG. 5 may achieve a pixel luminance continuity of respective pixels of the display panel in the entire gray-level region. As a result, a flat panel display device (e.g., a liquid crystal display device, an organic light emitting display device, etc.) employing the method of FIG. 5 may achieve high luminance uniformity in the entire gray-level region when outputting (i.e., displaying) an image. Although it is illustrated in FIG. 6 that the compensated gray-level region CLC includes a gray-level range between 0 and 80, the interpolated gray-level region ILC includes a gray-level range between 81 and 87, and the uncompensated gray-level region NLC includes a gray-level range between 88 and 255, the gray-level range of the compensated gray-level region, the gray-level range of the interpolated gray-level region, and the gray-level range of the third compensation gray-level region are not limited thereto.

Figure 7:
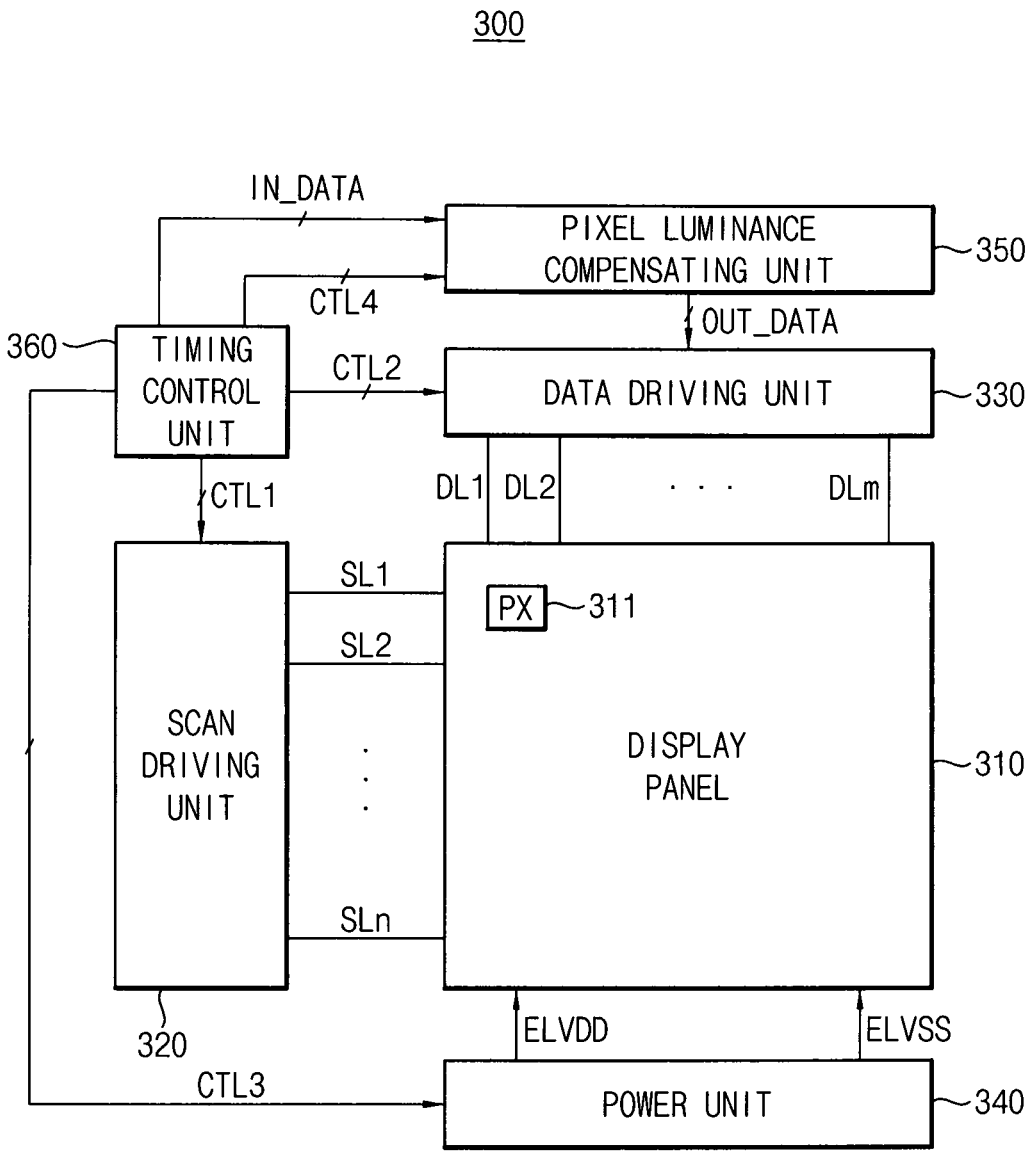
FIG. 7 is a block diagram illustrating an organic light emitting display device employing a sequential emission driving technique according to example embodiments.

FIG. 7 is a block diagram illustrating an organic light emitting display device employing a sequential emission driving technique according to example embodiments.

Referring to FIG. 7, the organic light emitting display device 300 may include a display panel 310, a scan driving unit 320, a data driving unit 330, a power unit 340, a pixel luminance compensating unit 350, and a timing control unit 360. Here, the organic light emitting display device 300 may employ the sequential emission driving technique. In one example embodiment, as illustrated in FIG. 7, the pixel luminance compensating unit 350 may be implemented outside the timing control unit 360 and the data driving unit 330. In another example embodiment, the pixel luminance compensating unit 350 may be integrated in the timing control unit 360 or the data driving unit 330.

The display panel 310 may include a plurality of pixels 311. The display panel 310 may be coupled to the scan driving unit 320 via a plurality of scan-lines SL1 through SLn, and may be coupled to the data driving unit 330 via a plurality of data-lines DL1 through DLm. Since the pixels 311 are arranged at locations corresponding to crossing points of the scan-lines SL1 through SLn and the data-lines DL1 through DLm, the display panel 310 may include n*m pixels 311. The scan driving unit 320 may provide a scan signal to the display panel 310. The data driving unit 330 may provide a data signal to the display panel 310. The power unit 340 may provide a high voltage ELVDD and a low voltage ELVSS to the display panel 310. The pixel luminance compensating unit 350 may compensate a pixel luminance of respective pixels 311 of the display panel 310 in a partial gray-level region. For this operation, the pixel luminance compensating unit 350 may include the uncompensated gray-level region processing unit, a compensated gray-level region processing unit, and a interpolated gray-level region processing unit. The uncompensated gray-level region processing unit may generate first output-data by processing first input-data corresponding to (i.e., placed in) the uncompensated gray-level region based on a luminance curve of the uncompensated gray-level region for respective pixels 311 included in the display panel 310. The compensated gray-level region processing unit may generate second output-data by processing second input-data corresponding to (i.e., placed in) a compensated gray-level region based on a luminance curve of the compensated gray-level region for respective pixels 311 included in the display panel 310. The interpolated gray-level region processing unit may generate third output-data by processing third input-data corresponding to (i.e., placed in) an interpolated gray-level region based on a luminance curve of the interpolated gray-level region for respective pixels 311 included in the display panel 310. Here, the luminance curve of the interpolated gray-level region may be generated based on an interpolation between the luminance curve of the uncompensated gray-level region and the luminance curve of the compensated gray-level region. Since these are described with reference to FIGS. 1 through 6, the duplicated descriptions will be omitted. The timing control unit 360 may control the scan driving unit 320, the data driving unit 330, the power unit 340, and the pixel luminance compensating unit 350 based on first through fourth control signals CTL1, CTL2, CTL3, and CTL4.

Figure 8:
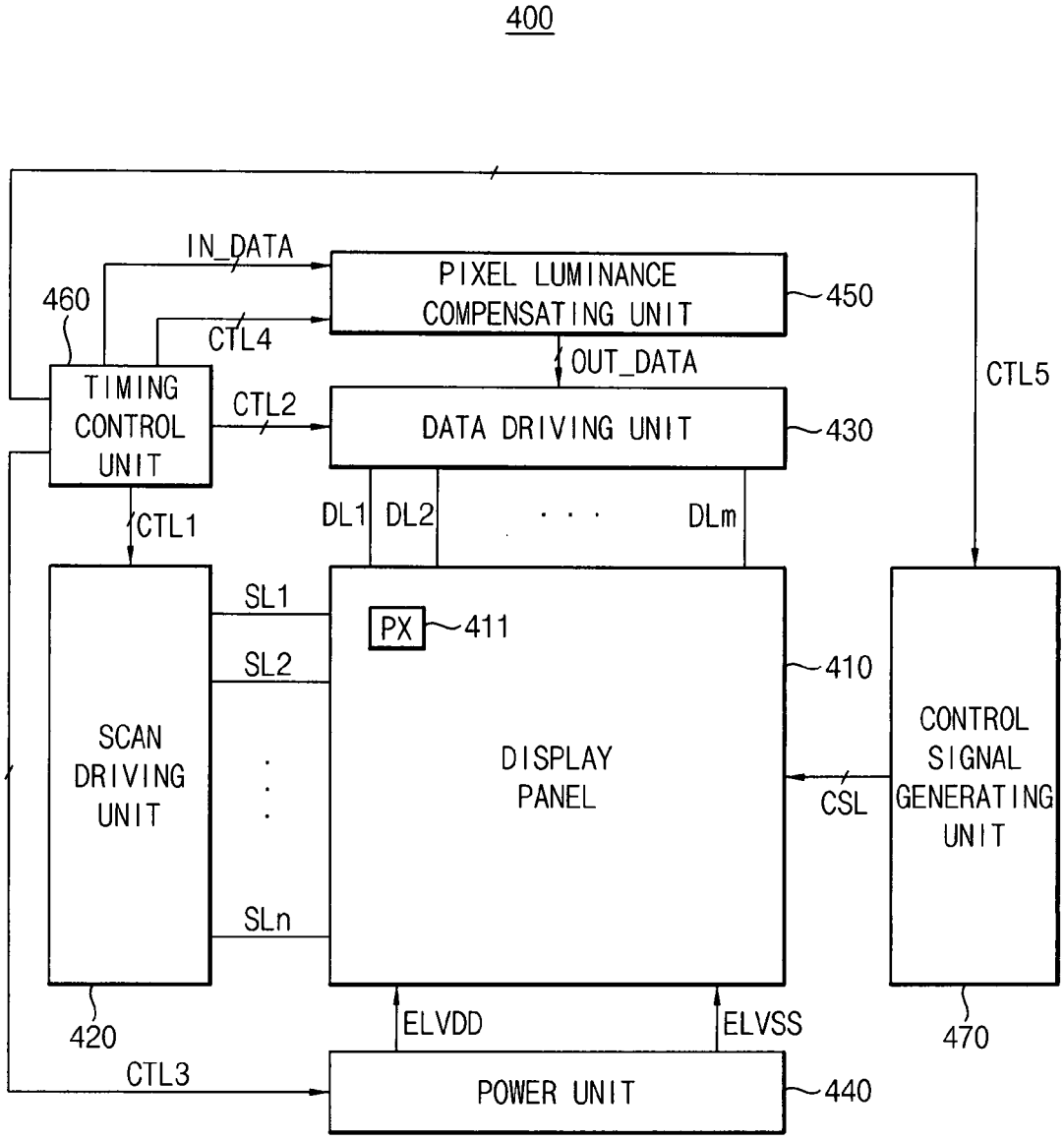
FIG. 8 is a block diagram illustrating an organic light emitting display device employing a simultaneous emission driving technique according to example embodiments.

FIG. 8 is a block diagram illustrating an example of an organic light emitting display device employing a simultaneous emission driving technique according to example embodiments.

Referring to FIG. 8, the organic light emitting display device 400 may include a display panel 410, a scan driving unit 420, a data driving unit 430, a power unit 440, a pixel luminance compensating unit 450, a timing control unit 460, and a control signal generating unit 470. Here, the organic light emitting display device 400 employs the simultaneous emission driving technique. In one example embodiment, as illustrated in FIG. 8, the pixel luminance compensating unit 450 is implemented outside the timing control unit 460 and the data driving unit 430. In another example embodiment, the pixel luminance compensating unit 450 may be integrated in the timing control unit 460 or the data driving unit 430.

The display panel 410 includes a plurality of pixels 411. The display panel 410 is coupled to the scan driving unit 420 via a plurality of scan-lines SL1 through SLn, is coupled to the data driving unit 430 via a plurality of data-lines DL1 through DLm, and is coupled to the control signal generating unit 470 via a plurality of control-lines. Since the pixels 411 are arranged at locations corresponding to crossing points of the scan-lines SL1 through SLn and the data-lines DL1 through DLm, the display panel 410 includes n*m pixels 411. The scan driving unit 420 provides a scan signal to the display panel 410. The data driving unit 430 provides a data signal to the display panel 410. The power unit 440 provides a high voltage ELVDD and a low voltage ELVSS to the display panel 410. The control signal generating unit 470 provides an emission control signal CSL to the display panel 410. Thus, the pixels 411 included in the display panel 410 simultaneously emits light in response to the emission control signal CSL. The pixel luminance compensating unit 450 compensates a pixel luminance of respective pixels 411 of the display panel 410 in a partial gray-level region. For this operation, the pixel luminance compensating unit 450 includes an uncompensated gray-level region processing unit, a compensated gray-level region processing unit, and an interpolated gray-level region processing unit. The uncompensated gray-level region processing unit generates first output-data by processing first input-data corresponding to (i.e., placed in) the uncompensated gray-level region based on a luminance curve of the uncompensated gray-level region for respective pixels 411 included in the display panel 410. The compensated gray-level region processing unit generates second output-data by processing second input-data corresponding to (i.e., placed in) a compensated gray-level region based on a luminance curve of the compensated gray-level region for respective pixels 411 included in the display panel 410. The interpolated gray-level region processing unit generates third output-data by processing third input-data corresponding to (i.e., placed in) an interpolated gray-level region based on a luminance curve of the interpolated gray-level region for respective pixels 411 included in the display panel 410. Here, the luminance curve of the interpolated gray-level region is generated based on an interpolation between the luminance curve of the uncompensated gray-level region and the luminance curve of the compensated gray-level region. Since these are described with reference to FIGS. 1 through 6, the duplicated descriptions will be omitted. The timing control unit 460 controls the scan driving unit 420, the data driving unit 430, the power unit 440, the pixel luminance compensating unit 450, and the control signal generating unit 470 based on first through fifth control signals CTL1, CTL2, CTL3, CTL4, and CTL5.

Figure 9:
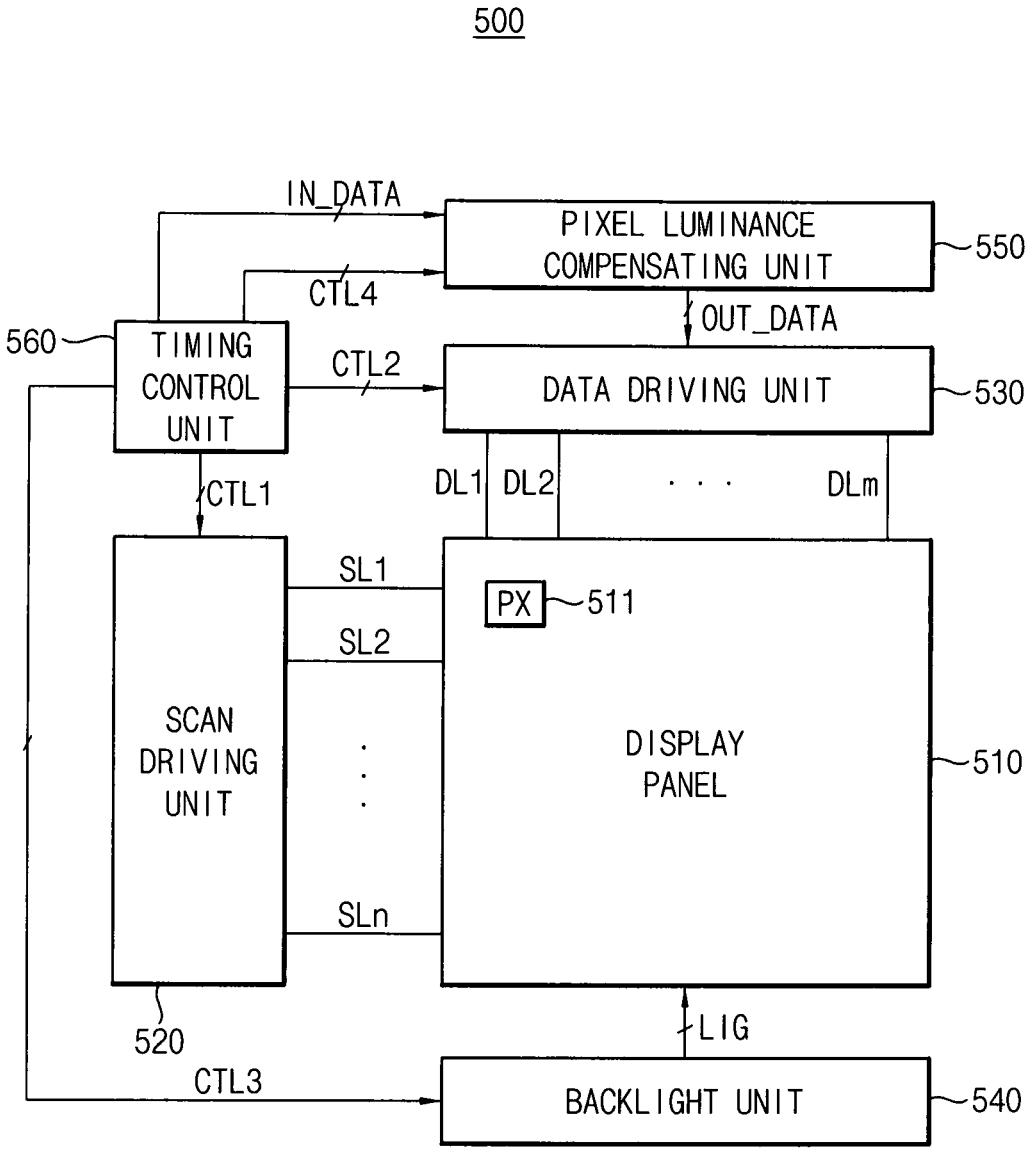
FIG. 9 is a block diagram illustrating a liquid crystal display device according to example embodiments.

FIG. 9 is a block diagram illustrating a liquid crystal display device according to example embodiments.

Referring to FIG. 9, the liquid crystal display device 500 includes a display panel 510, a scan driving unit 520, a data driving unit 530, a backlight unit 540, a pixel luminance compensating unit 550, and a timing control unit 560. Here, the liquid crystal display device 500 displays an image by controlling a light transmittance of respective liquid crystal layers of the pixels 511, where the liquid crystal layer is formed between a pixel electrode and a common electrode. In one example embodiment, as illustrated in FIG. 9, the pixel luminance compensating unit 550 is implemented outside the timing control unit 560 and the data driving unit 530. In another example embodiment, the pixel luminance compensating unit 550 is integrated in the timing control unit 560 or the data driving unit 530.

The display panel 510 includes a plurality of pixels 511. The display panel 510 is coupled to the scan driving unit 520 via a plurality of scan-lines SL1 through SLn, and is coupled to the data driving unit 530 via a plurality of data-lines DL1 through DLm. Since the pixels 511 are arranged at locations corresponding to crossing points of the scan-lines SL1 through SLn and the data-lines DL1 through DLm, the display panel 510 includes n*m pixels 511. The scan driving unit 520 provides a scan signal to the display panel 510. The data driving unit 530 provides a data signal to the display panel 510. The backlight unit 540 provides a light to the display panel 510. That is, an image is displayed on the display panel 510 when the light provided by the backlight unit 540 passes through respective liquid crystal layers of the pixels 511. The pixel luminance compensating unit 550 compensates a pixel luminance of respective pixels 511 of the display panel 510 in a partial gray-level region. For this operation, the pixel luminance compensating unit 550 includes an uncompensated gray-level region processing unit, a compensated gray-level region processing unit, and an interpolated gray-level region processing unit. The uncompensated gray-level region processing unit generates first output-data by processing first input-data corresponding to (i.e., placed in) an uncompensated gray-level region based on a luminance curve of the uncompensated gray-level region for respective pixels 511 included in the display panel 510. The compensated gray-level region processing unit generates second output-data by processing second input-data corresponding to (i.e., placed in) a compensated gray-level region based on a luminance curve of the compensated gray-level region for respective pixels 511 included in the display panel 510. The interpolated gray-level region processing unit generates third output-data by processing third input-data corresponding to (i.e., placed in) an interpolated gray-level region based on a luminance curve of the interpolated gray-level region for respective pixels 511 included in the display panel 510. Here, the luminance curve of the interpolated gray-level region is generated based on an interpolation between the luminance curve of the uncompensated gray-level region and the luminance curve of the compensated gray-level region. Since these are described with reference to FIGS. 1 through 6, the duplicated descriptions will be omitted. The timing control unit 560 controls the scan driving unit 520, the data driving unit 530, the backlight unit 540, and the pixel luminance compensating unit 550 based on first through fourth control signals CTL1, CTL2, CTL3, and CTL4.

Figure 10:
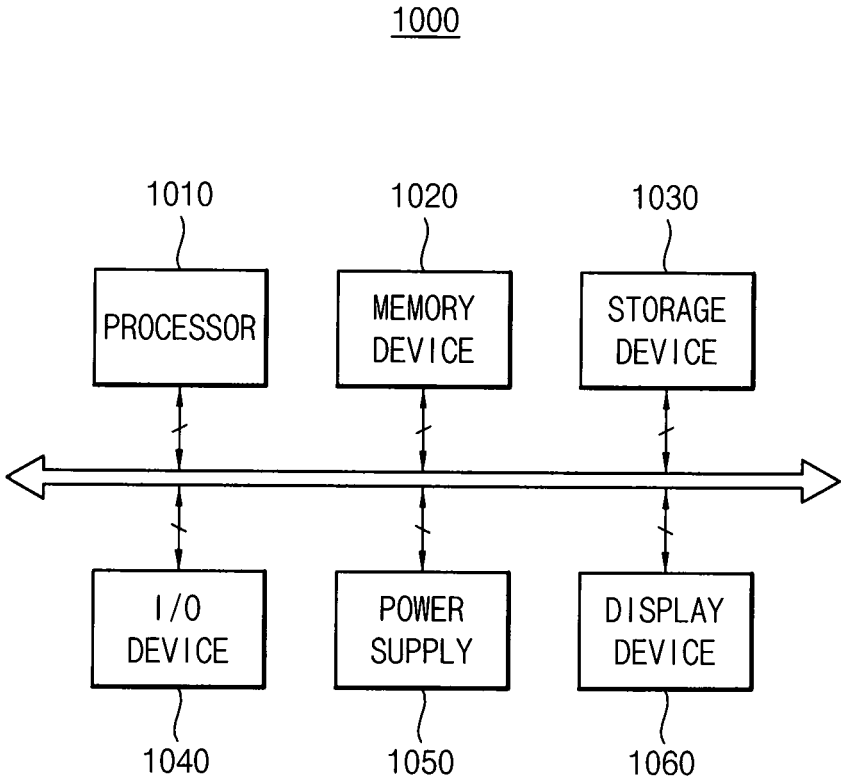
FIG. 10 is a block diagram illustrating an electronic device having a flat panel display device according to example embodiments.

FIG. 10 is a block diagram illustrating an electronic device having a flat panel display device according to example embodiments.

Referring to FIG. 10, the electronic device 1000 includes a processor 1010, a memory device 1020, a storage device 1030, an input/output (I/O) device 1040, a power supply 1050, and a flat panel display device 1060. Here, the flat panel display device 1060 corresponds to the organic light emitting display device 300 of FIG. 7, the organic light emitting display device 400 of FIG. 8, or the liquid crystal display device 500 of FIG. 9. In addition, the electronic device 1000 further includes a plurality of ports for communicating a video card, a sound card, a memory card, a universal serial bus (USB) device, other electronic devices, etc.

The processor 1010 performs various computing functions. The processor 1010 can be a microprocessor, a central processing unit (CPU), etc. The processor 1010 is coupled to other components via an address bus, a control bus, a data bus, etc. Further, the processor 1010 may be coupled to an extended bus such as a peripheral component interconnection (PCI) bus. The memory device 1020 stores data for operations of the electronic device 1000. For example, the memory device 1020 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 1030 may be a solid state drive (SSD) device, a hard disk drive (HDD) device, a CD-ROM device, etc.

The I/O device 1040 may be an input device such as a keyboard, a keypad, a touchpad, a touch-screen, a mouse, etc., and an output device such as a printer, a speaker, etc. According to some example embodiments, the flat panel display device 1060 may be included in the I/O device 1040. The power supply 1050 provides a power for operations of the electronic device 1000. The flat panel display device 1060 communicates with other components via the buses or other communication links. As described above, the flat panel display device 1060 includes a pixel luminance compensating unit that compensates a pixel luminance of respective pixels of a display panel in a partial gray-level region. For this operation, the pixel luminance compensating unit includes an uncompensated gray-level region processing unit, a compensated gray-level region processing unit, and an interpolated gray-level region processing unit. The uncompensated gray-level region processing unit generates first output-data by processing first input-data corresponding to (i.e., placed in) an uncompensated gray-level region based on a luminance curve of the uncompensated gray-level region for respective pixels included in the display panel. The compensated gray-level region processing unit generates second output-data by processing second input-data corresponding to (i.e., placed in) a compensated gray-level region based on a luminance curve of the compensated gray-level region for respective pixels included in the display panel. The interpolated gray-level region processing unit generates third output-data by processing third input-data corresponding to (i.e., placed in) an interpolated gray-level region based on a luminance curve of the interpolated gray-level region for respective pixels included in the display panel. Here, the luminance curve of the interpolated gray-level region is generated based on an interpolation between the luminance curve of the uncompensated gray-level region and the luminance curve of the compensated gray-level region.

The present inventive concept may be applied to an electronic device having a flat panel display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A pixel luminance compensating unit configured to receive input-data comprising an input luminance curve having a plurality of luminance values measured from pixels of a display panel during light emission and to process the input-data prior to generating output-data, the compensating unit comprising:

an uncompensated gray-level region processing unit configured to generate first output-data by processing first input-data corresponding to a first portion of the measured input luminance curve corresponding to an uncompensated gray-level region;

a compensated gray-level region processing unit configured to generate second output-data by processing second input-data corresponding to a second portion of the measured input luminance curve corresponding to a compensated gray-level region; and an interpolated gray-level region processing unit configured to generate third output-data by processing third input-data corresponding to a third portion of the measured input luminance curve corresponding to an interpolated gray-level region, wherein the interpolated gray-level region processing unit is configured to generate the third portion by interpolating between the first portion and the second portion, wherein the first output-data, the second output-data and the third output-data are continuously connected along a gray level axis of the measured input luminance curve and are generated based on the luminance values of respective first, second and third portions, and wherein the interpolated gray-level region is between the compensated gray-level region and the uncompensated gray-level region with respect to the gray-level axis.

2. The unit of claim 1, wherein the interpolated gray-level region is immediately adjacent to and directly connects the compensated gray-level region and the uncompensated gray-level region with respect to the gray-level axis of the measured input luminance curve.

3. The unit of claim 2, wherein the uncompensated gray-level region corresponds to a relatively high luminance gray-level region, and the compensated and interpolated gray-level regions correspond to a relatively low luminance gray-level region.

4. The unit of claim 2, wherein the uncompensated gray-level region corresponds to a relatively low luminance gray-level region, and the compensated and interpolated gray-level regions correspond to a relatively high luminance gray-level region.

5. The unit of claim 2, wherein the first portion, the second portion, and the third portion are connected along the gray-level axis of the measured input luminance curve, and wherein the third portion is immediately adjacent to and directly between the first portion and the second portion.

6. The unit of claim 5, wherein the uncompensated gray-level region processing unit is configured to generate the first output-data by not performing pixel luminance compensation on the first input-data.

7. The unit of claim 5, wherein the compensated gray-level region processing unit is configured to generate the second output-data by performing pixel luminance compensation on the second input-data.

8. The unit of claim 5, wherein the interpolated gray-level region processing unit is configured to generate the third output-data by performing pixel luminance compensation on the third input-data.

9. A flat panel display device having a plurality of pixels, the device comprising:

a display panel;

a scan driving unit configured to provide a scan signal to the display panel;

a data driving unit configured to provide a data signal to the display panel;

a pixel luminance compensating unit configured to receive a measured luminance curve having a plurality of luminance values measured from pixels of the display panel during light emission and to use the measured luminance curve to compensate the luminance of the pixels corresponding to a portion of an entire grey level region of the measured luminance curve; and a timing control unit configured to control the scan driving unit, the data driving unit, and the pixel luminance compensating unit, wherein the pixel luminance compensating unit includes:

an uncompensated gray-level region processing unit configured to generate first output-data by processing first input-data corresponding to a first portion of an input luminance curve corresponding to an uncompensated gray-level region;

a compensated gray-level region processing unit configured to generate second output-data by processing second input-data corresponding to a second portion of the input luminance curve corresponding to a compensated gray-level region; and an interpolated gray-level region processing unit configured to generate third output-data by processing third input-data corresponding to a third portion of the input luminance curve corresponding to an interpolated gray-level region, wherein the interpolated gray-level region processing unit is configured to generate the third portion by interpolating between the first portion and the second portion, wherein the first output-data, the second output-data and the third output-data are continuously connected along a gray level axis of the measured input luminance curve and are generated based on the luminance values of respective first, second and third portions, and wherein the interpolated gray-level region is between the compensated gray-level region and the uncompensated gray-level region with respect to the gray-level axis.

10. The device of claim 9, wherein the pixel luminance compensating unit is integrated with the timing control unit or the data driving unit.

11. The device of claim 9, wherein the flat panel display device corresponds to an organic light emitting display device including a power unit configured to provide a high voltage and a low voltage to the display panel.

12. The device of claim 9, wherein the flat panel display device corresponds to a liquid crystal display device including a backlight unit configured to provide light to the display panel.

13. The device of claim 9, wherein the interpolated gray-level region is between the compensated gray-level region and the uncompensated gray-level region along a gray-level axis of the input luminance curve.

14. The device of claim 13, wherein the first portion, the second portion, and the third portion are connected along the gray-level axis of the input luminance curve.

15. The device of claim 14, wherein the uncompensated gray-level region processing unit is configured to generate the first output-data by not performing pixel luminance compensation on the first input-data.

16. The device of claim 14, wherein the compensated gray-level region processing unit is configured to generate the second output-data by performing pixel luminance compensation on the second input-data.

17. The device of claim 14, wherein the interpolated gray-level region processing unit is configured to generate the third output-data by performing pixel luminance compensation on the third input-data.

18. A method of adjusting a luminance curve for respective pixels included in a display panel, the method comprising:

detecting a luminance curve having a plurality of luminance values measured from the pixels of the display panel during light emission, the measured luminance curve corresponding to an entire gray-level region for the respective pixels;

checking a first portion of the measured luminance curve corresponding to an uncompensated gray-level region for the respective pixels;

adjusting a second portion of the measured luminance curve corresponding to an compensated gray-level region for the respective pixels; and generating a third portion of the measured luminance curve corresponding to an interpolated gray-level region for the respective pixels by interpolating between the first portion and the second portion, wherein the first, second and third portions are continuously connected along a gray level axis of the measured input luminance curve, and wherein the interpolated gray-level region is between the compensated gray-level region and the uncompensated gray-level region with respect to the gray-level axis.

19. The method of claim 18, wherein the interpolated gray-level region is between the compensated gray-level region and the uncompensated gray-level region with respect to the gray-level axis of the measured luminance curve, and wherein the first portion, the second portion, and the third portion are directly connected along the gray-level axis of the measured luminance curve.

* * * * *